US008573612B1

(12) United States Patent
Fulk et al.

(10) Patent No.: US 8,573,612 B1
(45) Date of Patent: Nov. 5, 2013

(54) ASSISTIVE AMBULATORY DEVICE

(75) Inventors: George D. Fulk, Potsdam, NY (US); James J. Carroll, Potsdam, NY (US)

(73) Assignee: Clarkson University, Potsdam, NY (US)

( * ) Notice: Subject to any disclaimer, the term of this patent is extended or adjusted under 35 U.S.C. 154(b) by 588 days.

(21) Appl. No.: 11/716,399

(22) Filed: Mar. 9, 2007

Related U.S. Application Data

(60) Provisional application No. 60/780,380, filed on Mar. 9, 2006.

(51) Int. Cl.
*A61H 3/04* (2006.01)

(52) U.S. Cl.
USPC ..... 280/87.021; 135/67; 482/68

(58) Field of Classification Search
USPC ..... 280/87.051, 87.05, 87.041, 87.03, 280/87.021; 135/67, 74; 482/66, 67, 68
See application file for complete search history.

(56) References Cited

U.S. PATENT DOCUMENTS

| | | | | | |
|---|---|---|---|---|---|
| 3,098,651 | A * | 7/1963 | Murcott | 482/66 |
| 3,442,276 | A * | 5/1969 | Thomas et al. | 135/67 |
| 3,516,425 | A * | 6/1970 | Rigal | 135/67 |
| 4,094,330 | A * | 6/1978 | Jong | 135/67 |
| 4,180,086 | A * | 12/1979 | Thomas | 135/67 |
| 4,342,465 | A * | 8/1982 | Stillings | 280/87.051 |
| 4,619,282 | A * | 10/1986 | Battiston | 135/67 |
| 4,621,804 | A * | 11/1986 | Mueller | 280/87.041 |
| 4,830,035 | A * | 5/1989 | Liu | 135/67 |
| 5,174,590 | A * | 12/1992 | Kerley et al. | 280/1.5 |
| 5,188,139 | A * | 2/1993 | Garelick | 135/67 |
| 5,201,333 | A * | 4/1993 | Shalmon et al. | 135/67 |
| 5,433,235 | A * | 7/1995 | Miric et al. | 135/67 |
| 5,509,152 | A * | 4/1996 | Kippes | 5/81.1 R |
| 5,529,425 | A * | 6/1996 | Spies et al. | 403/322.4 |
| 5,579,793 | A * | 12/1996 | Gajewski et al. | 135/67 |
| 5,819,772 | A * | 10/1998 | Pi | 135/66 |
| 5,979,476 | A * | 11/1999 | Cranny | 135/67 |
| 6,729,342 | B2 * | 5/2004 | Serhan | 135/67 |
| 7,278,436 | B2 * | 10/2007 | Gale et al. | 135/74 |
| 7,506,657 | B2 * | 3/2009 | Hsiao | 135/67 |
| 2007/0233403 | A1 * | 10/2007 | Alwan et al. | 702/33 |

* cited by examiner

*Primary Examiner* — Jeffrey J Restifo
(74) *Attorney, Agent, or Firm* — Gerow D Brill

(57) ABSTRACT

A method of producing a natural gait by a patient using an ambulatory device having a patient positioned in the middle of the ambulatory device to allow for an upright trunk, minimizing abnormal lower extremities kinematics and weight bearing on arms. By having hinged corners with an adjustable friction the device allows reciprocal arm swing when unlocked. The use of four wheels permits a continuous stepping motion that does not disrupt normal gait kinematics. Having an adjustable height allows the ambulatory device to have an optimal height for placement of patient hands that minimizes weight bearing on arms.

30 Claims, 11 Drawing Sheets

ASSISTIVE AMBULATORY DEVICE

CROSS REFERENCE

This application is related to provisional application 60/780,380 filed on Mar. 9, 2006 entitled A Novel Assistive Ambulatory Device.

FIELD OF INVENTION

This disclosure relates to walking assistive devices for individuals with neurological injuries such as spinal cord injury, stroke, and multiple sclerosis. Walking assistive devices are also used by individuals who have auto-immune diseases such as Lupus, Muscular Dystrophy and Myasthenia. These individuals often have difficulty walking without assistance and require ambulatory assistive devices such as a cane or walker.

BACKGROUND OF INVENTION

Individuals with neurological injuries and auto-immune diseases such as spinal cord injury, stroke, Lupus, Muscular Dystrophy, Myasthenia and Multiple Sclerosis often have difficulty walking. Approximately one third of people that experience a stroke will not be able to walk or will require assistance to walk 3 months after their stroke (See Jorgensen et al. 1995.) and between 30% and 50% of individuals with Multiple Sclerosis have difficulty walking. See Ghezzi et al., 2002; Pittock et al., 2004; and Myhr et al., 2001. Locomotor training utilizing a body weight support system and treadmill, as shown below in FIG. 1, has been advocated as an effective intervention strategy to improve walking ability for individuals with stroke, spinal cord injury and MS. See Sullivan et al. 2002; Dobkin, 1999; Fulk, 2004; Nilsson, 2001 Behrman et al., 2000; Dobkin et al., 2003; and Fulk, 2005 cited below. Locomotor training principles were developed from basic science research with spinalized cats. See Lovely et al., 1986; Edgerton et al. 1991; Barbeau et al., 1987; and Barbeau 2003.

Based on this translational research, Behrman and Harkema, (See Behrman et al., 2000.) developed an expanded list of guiding principles for locomotive training with humans. These principles include: 1) training at stepping speeds that approximate normal walking speeds, 2) maintain maximum sustainable load on the lower extremities in stance, 3) maintain an erect head and trunk, 4) approximate normal lower extremities kinematics when stepping, 5) synchronize hip extension with loading of the opposite lower extremities, 6) minimize weight bearing on the arms and facilitate reciprocal arm swing, and 7) minimize sensory stimulation that is in conflict with normal sensory information consistent with walking.

Following these principles will optimize sensory input related to walking, thereby optimizing the development of neural patterns for locomotion. These principles emphasize recovery of locomotion using the intrinsic mechanisms of the nervous system rather than compensation strategies.

An important component of locomotive training is to apply these principles while training over ground and in the community as well as with body weight support on a tread mill. The end goal of the training is for the clients to be able to walk independently in their home and community. Currently, physical therapists utilize various assistive devices such as walkers, canes, and crutches when locomotor training over ground and in the community. However, these devices may not allow for the effective application of Behrman and Harkema's guiding principles, as stated above. For example, when an individual utilizes a rolling-style walker, also known as a rollator, to ambulate their trunk is flexed throughout the gait cycle, as shown below in FIG. 2.

The rolling type of ambulatory assistive device does not allow for natural hip extension at the end of stance or other normal kinematics in the lower extremity and upper extremity joints. Furthermore, rollators do not permit the type of reciprocal arm swing associated with natural gait. Non-wheeled walkers have a further disadvantage of a requiring a cyclical lifting motion that further deviates from normal gait. Other assistive ambulatory devices, such as crutches or canes, may also alter gait kinematics when walking and allow for increased weight bearing on lower extremity joints and the arms, which may provide inappropriate sensory feedback to the spinal cord that does not resemble normal gait.

SUMMARY OF INVENTION

The object of this disclosure is to describe a device and method to improve the kinematics in lower and upper extremity joint by providing a natural gait with an ambulatory assistive device.

The assistive ambulatory device includes: a front assembly; a rear assembly; a pair of side assemblies; a pair of side beams; a plurality of hinged corners; a pair of front legs; a pair of rear legs; a pair of casters; a plurality of wheels; and an adjustable height. The plurality of hinged corners provides a natural gait of patient movement.

A front portion of a first side assembly is coupled through a first upper bushing, a first portion of a front assembly, a first lower bushing, and a front portion of a first side beam with a clamp assembly to a first front leg. A front portion of a second side assembly is coupled through a second upper bushing, a second portion of a front assembly, a second lower bushing, and a front portion of a second side beam with a clamp assembly to a second front leg. A rear portion of the first side assembly is coupled through the first upper bushing, the first portion of a front assembly, the first lower bushing, and the front portion of the first side beam with a clamp assembly to a first front leg. The front portion of a second side assembly is coupled through a second upper bushing, a second portion of a front assembly, a second lower bushing, and a front portion of a second side beam with a clamp assembly to a second front leg. Several accessory devices may be attached to the assistive ambulatory device personal digital assistant with a data acquisition capability, strain gages, and wheel encoders that may be used to provide data to a therapist. The data acquisition capability includes real time feedback to the user and therapist regarding how much weight is being borne through each arm; real time feedback to user and therapist on user's speed of walking and distance; and/or a wireless headset that can be programmed to a specific walking/training cadence to provide a pace goal for user. With a personal digital assistant equipped with a wireless connection the therapist can monitor and change training parameters remotely and the collected gait data can be stored, downloaded, and analyzed by a therapist to document patient progress and permit goal setting.

This disclosure also describes a method of producing a natural gait by a patient using an ambulatory device having a patient positioned in the middle of the ambulatory device to allow for an upright trunk, minimizing abnormal lower extremities kinematics and weight bearing on arms. By having hinged corners with an adjustable friction the device allows reciprocal arm swing when unlocked. The use of four wheels permits a continuous stepping motion that does not disrupt normal gait kinematics. Having an adjustable height allows the ambulatory device to have an optimal height for placement of patient hands that minimizes weight bearing on arms.

In addition to a unique walker as described above, certain four wheel rollators can be modified with a hinged system similar to that described above and as illustrated in FIGS. 4 and 5. Such a modified rollator device would have a plurality of hinging devices mounted on each leg of the rollator wherein said rollator can changed from a rectangular shape to a parallelogram with a left side in front or a right side in front. A modified rollator would provide some of the features of the natural gait walker, but not all of them.

BRIEF DESCRIPTION OF DRAWINGS

The foregoing aspects and many of the attendant advantages of this device and method will become more readily appreciated as the same becomes better understood by reference to the following detailed description, when taken in conjunction with the accompanying drawings, wherein.

DETAILED DESCRIPTION

Figure 1:
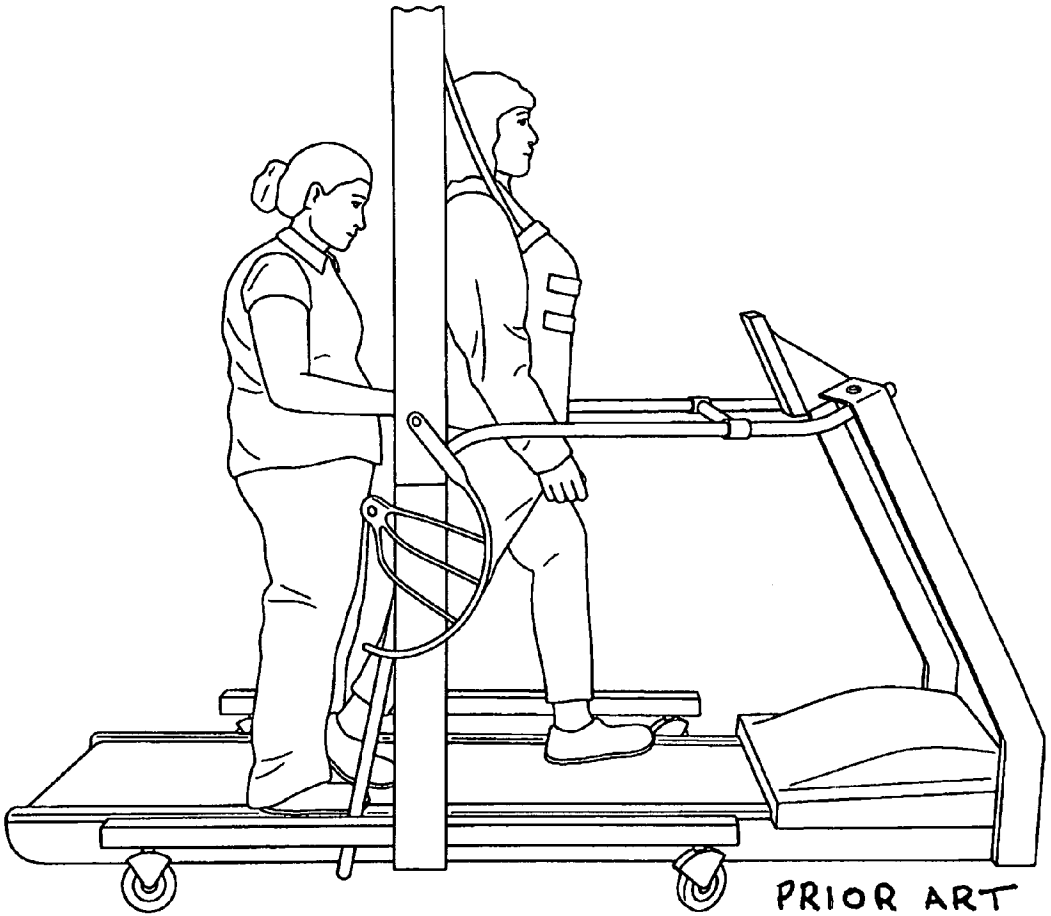
FIG. 1 illustrates a patient utilizing a body weight support system and treadmill.
Figure 2:
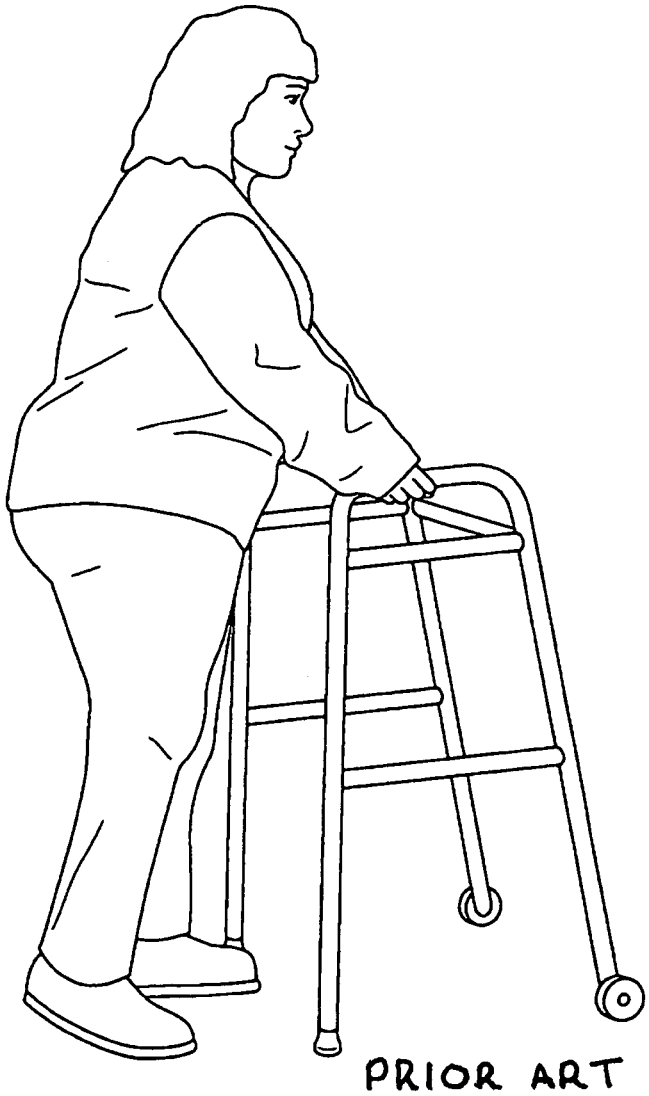
FIG. 2 illustrates patient utilizing a conventional Rollator-style walker.
Figure 3:
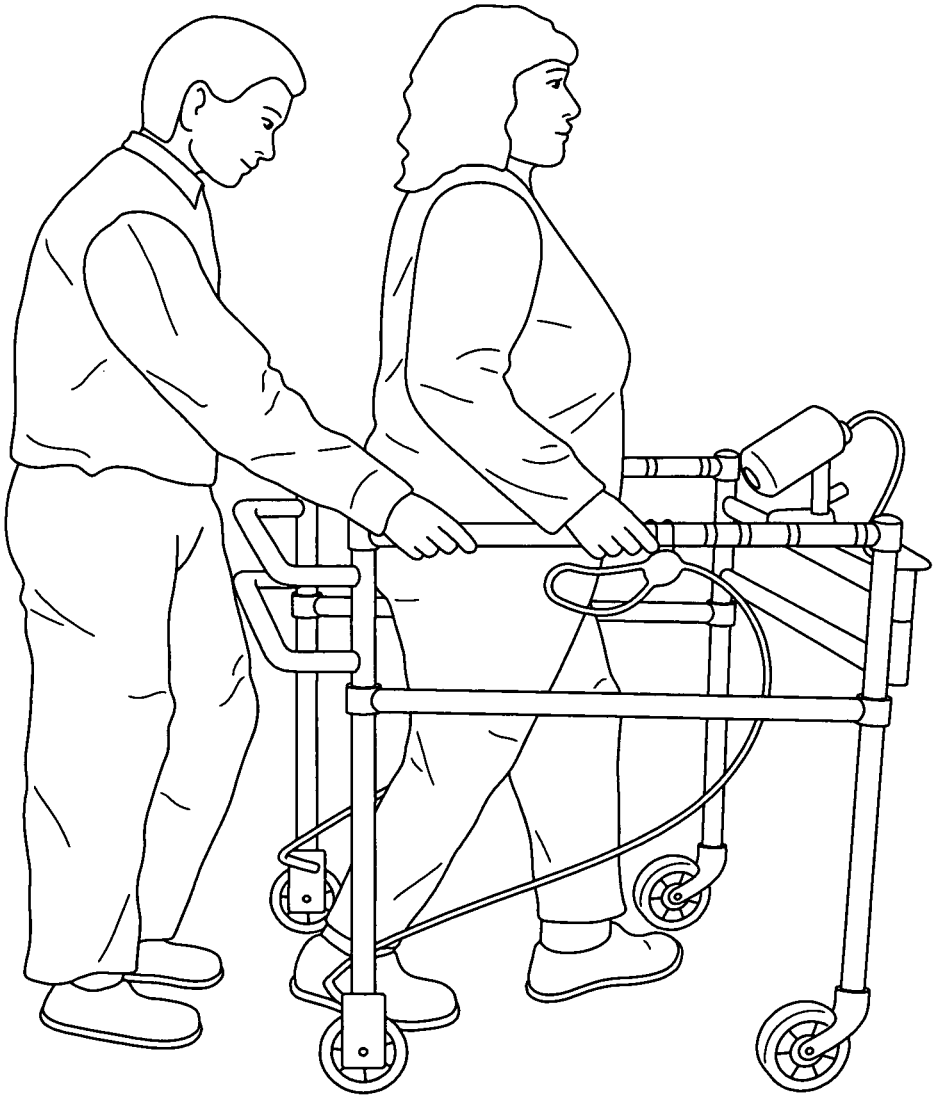
FIG. 3 illustrates a patient utilizing the natural gait walker with PDA-based data logging.

This disclosure describes an innovative, instrumented ambulatory assistive device called the natural gait walker illustrated in FIG. 3, that may allow for better incorporation of the guiding locomotive training principles while training and walking and that may lead to improved walking ability. The novel features of this ambulatory assistive device allow the user and therapist to effectively address the guiding principles of locomotor training, as noted above, when training and walking over level surfaces and in the community.

Key features of the proposed natural gait walker include:

- User is positioned in the middle of the walker to allow for upright trunk, minimizing abnormal LE kinematics and weight bearing on arms;
- Hinged corners with adjustable friction allow for reciprocal arm swing when unlocked;
- Four wheels permit continuous stepping motion that does not disrupt normal gait kinematics;
- Height adjustable to allow the therapist to set an optimal height for placement of hands to minimize weight bearing on the arms;
- Optionally equipped with a personal digital assistant (PDA) with a data acquisition capability, strain gages, and wheel encoders:
  - Provides real time feedback to the user and therapist regarding how much weight is being borne through each arm
  - Provides real time feedback to user and therapist on speed of walking and distance
  - Equipped with wireless headset that can be programmed to a specific walking/training cadence to provide a pace goal to user
  - Personal digital assistant equipped with wireless connection so therapist can monitor and change training parameters remotely
  - Collected gait data can be stored, downloaded, and analyzed by therapist to document patient progress and permit goal setting.

Figure 4:
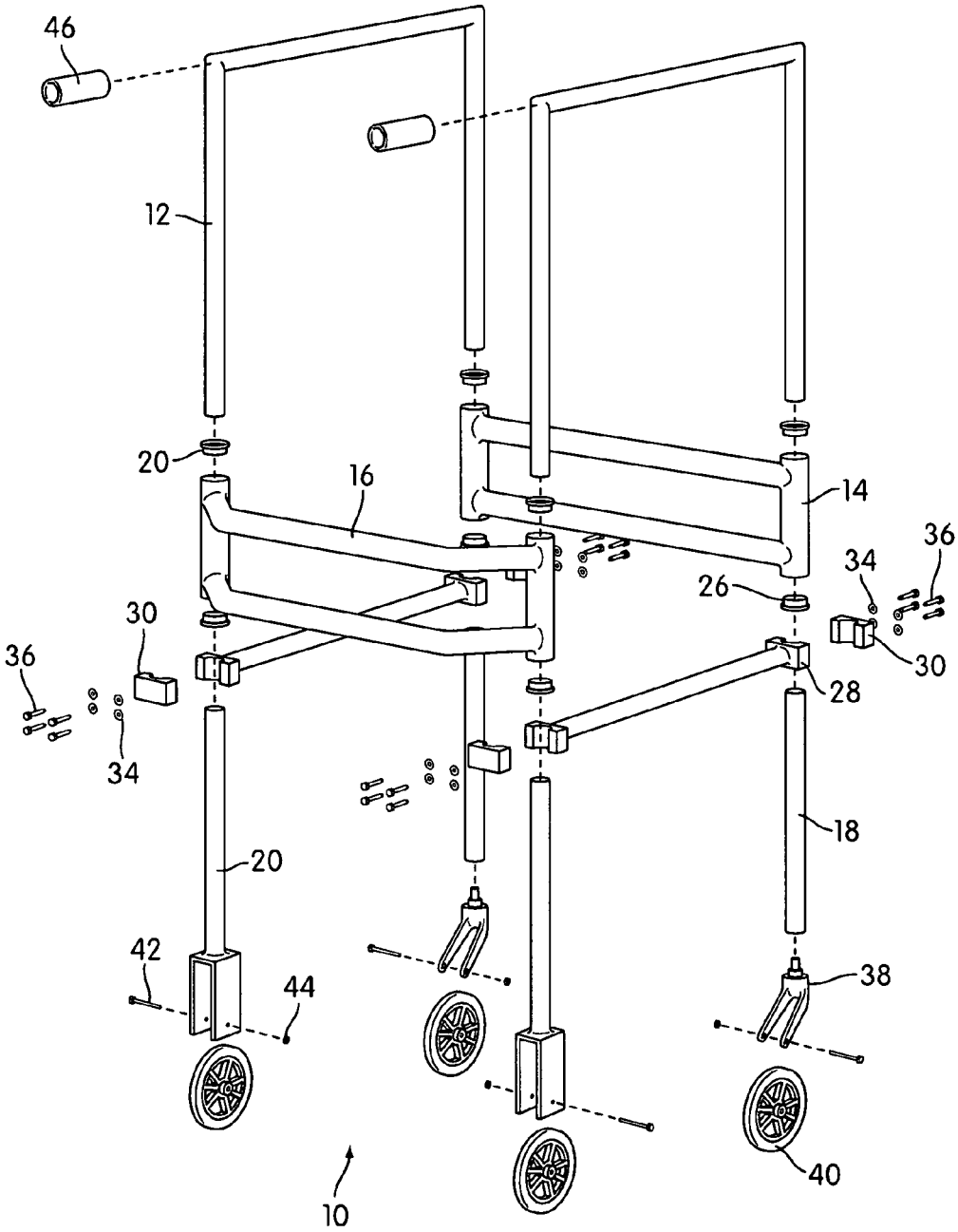
FIG. 4 illustrates an exploded mechanical diagram of the natural gait walker.

Mechanical Design of the Natural Gait Walker™:] Natural Gait Walker:

The construction of the natural gait walker comprises a plurality of aluminum tubing materials held together by clamps and bolts made of various materials as illustrated in FIG. 4.

The natural gate walker 10 is a four sided device having a pair of fl-shaped side assemblies 12 coupled to a front assembly 14 and a rear assembly 16. One leg 18 of the each side assembly 12 is coupled to the front assembly 14 by an upper bushing 20. The other leg 22 of each side assembly 12 is coupled to the rear assembly 16 by another upper bushing 20.

Figure 5:
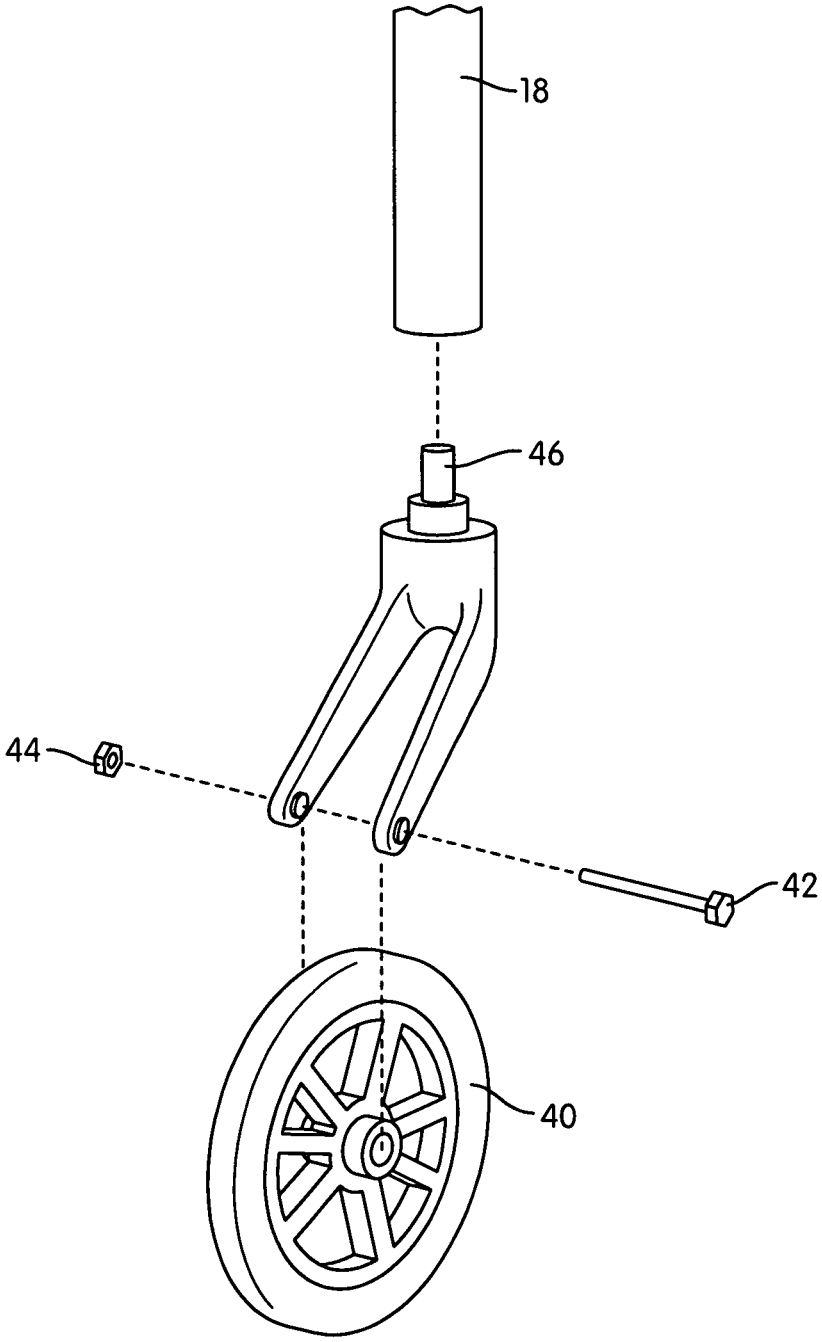
FIG. 5 illustrates a close-up view of the front wheel assembly.

The lower portions of the front assembly 14 are coupled to a first end of each side beam 24 by a lower bushing 26. The lower portions of the rear assembly 16 are coupled to the other end of each side beam 24 by a lower bushing 26. FIG. 5 illustrates a close up a corner assembly containing a side assembly 12, an upper bushing 20, a front assembly 14 a lower bushing 26 and a side beam 24.

The lower portion of the natural gait walker contains a pair of side beams 24 each side beam having a first end clamp 26 coupled to an upper portion of a front leg 30. The coupling is accomplished with a corner clamp 32 and the first end clamp 26 fastened around a front leg 30 by a plurality clamp bolts 34 and clamp washers 36.

Each side beam has a second end clamp 38 coupled to an upper portion of a rear leg 40. The coupling is accomplished with a corner clamp 32 and an end clamp 26 fastened around the rear leg 40 by a plurality clamp bolts 34 and clamp washers 36.

Figure 6:
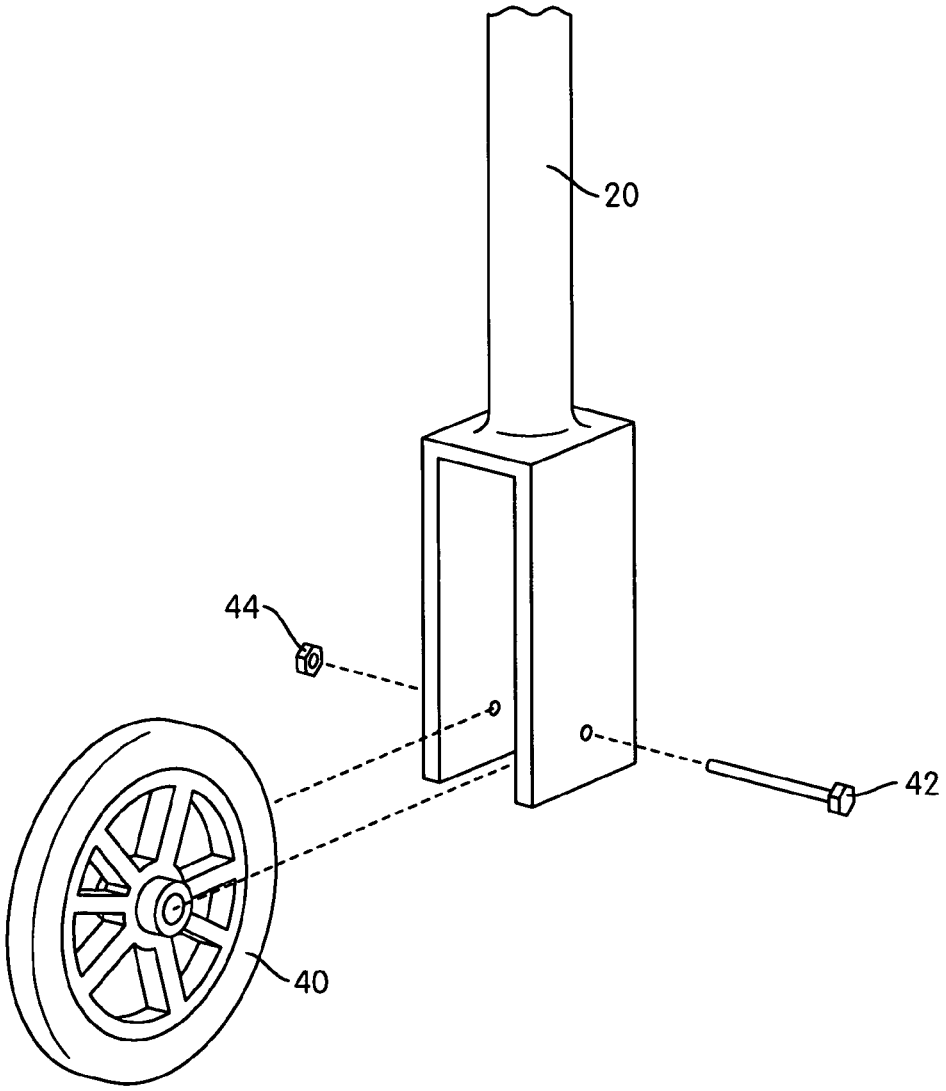
FIG. 6 illustrates a close-up view of the rear wheel assembly.

As illustrated in FIG. 6, each corner clamp 32 has an opening between the flat outside 42 and the peak of the hemisphere shaped inside surface 44 that mates up with one of a plurality of spring loaded dimples 46 on the front legs 30 and the rear legs 40 to allow the therapist or user to set an optimal height for placement of hands to minimize weight bearing on the arms.

Figure 7:
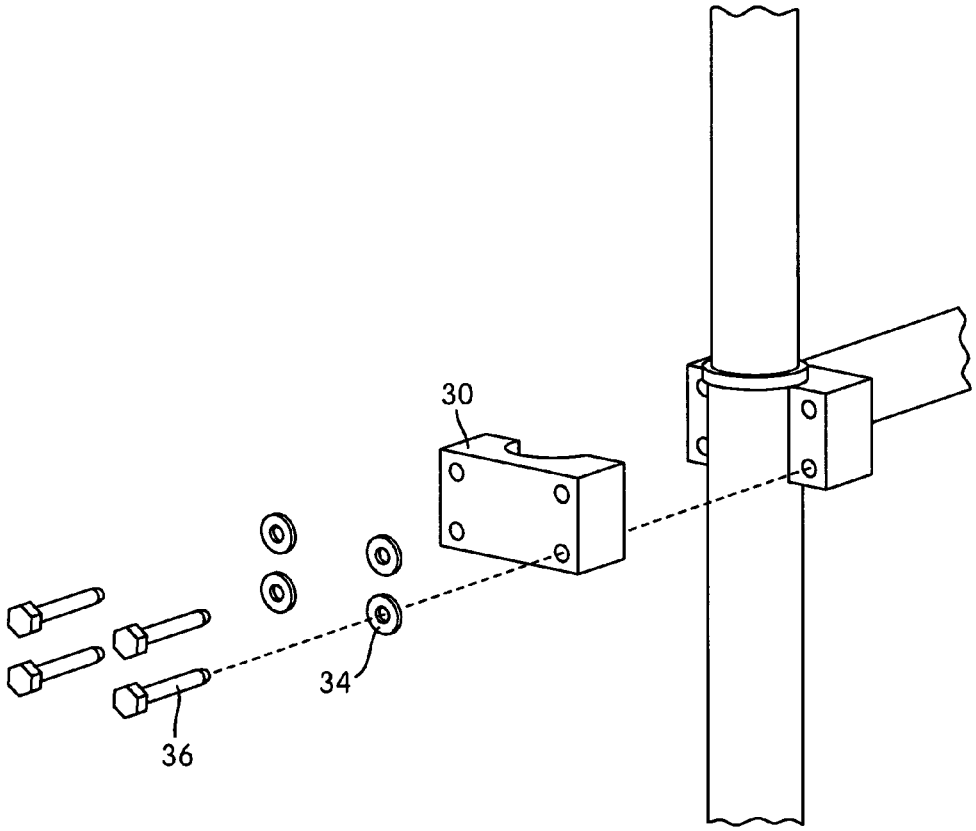
FIG. 7 illustrates a first close-up view of a corner assembly.

As illustrated in FIG. 7, the lower portion of each front leg 30 is coupled to a caster 46 which is fastened to a wheel 48 with a wheel bolt 50 and a wheel nut 52.

Figure 8:
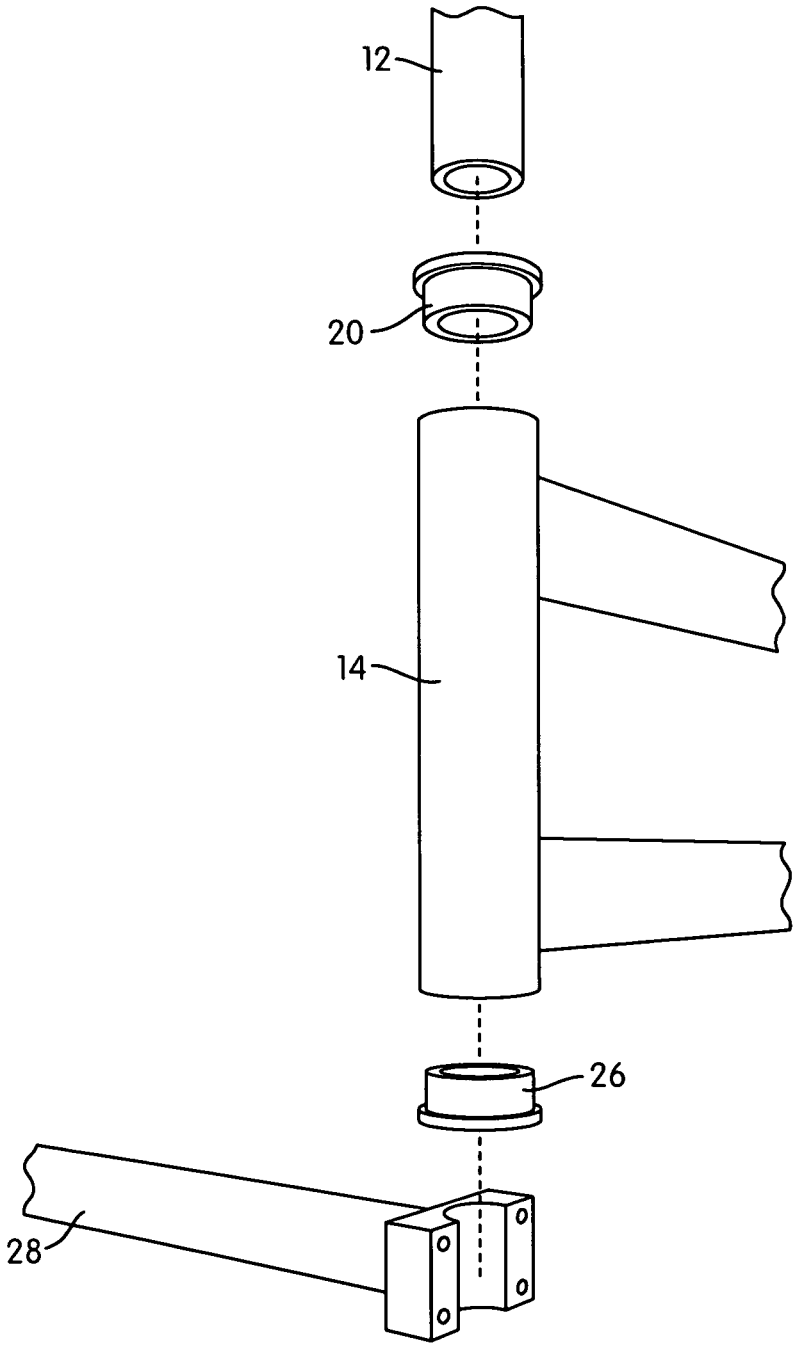
FIG. 8 illustrates a second close-up view of a corner assembly.

As illustrated in FIG. 8 the lower portion of each rear leg has a wheel support portion 54 with a pair of openings 56 for mounting a wheel 48 with a wheel bolt 50 and a wheel nut 52.

Figure 9:
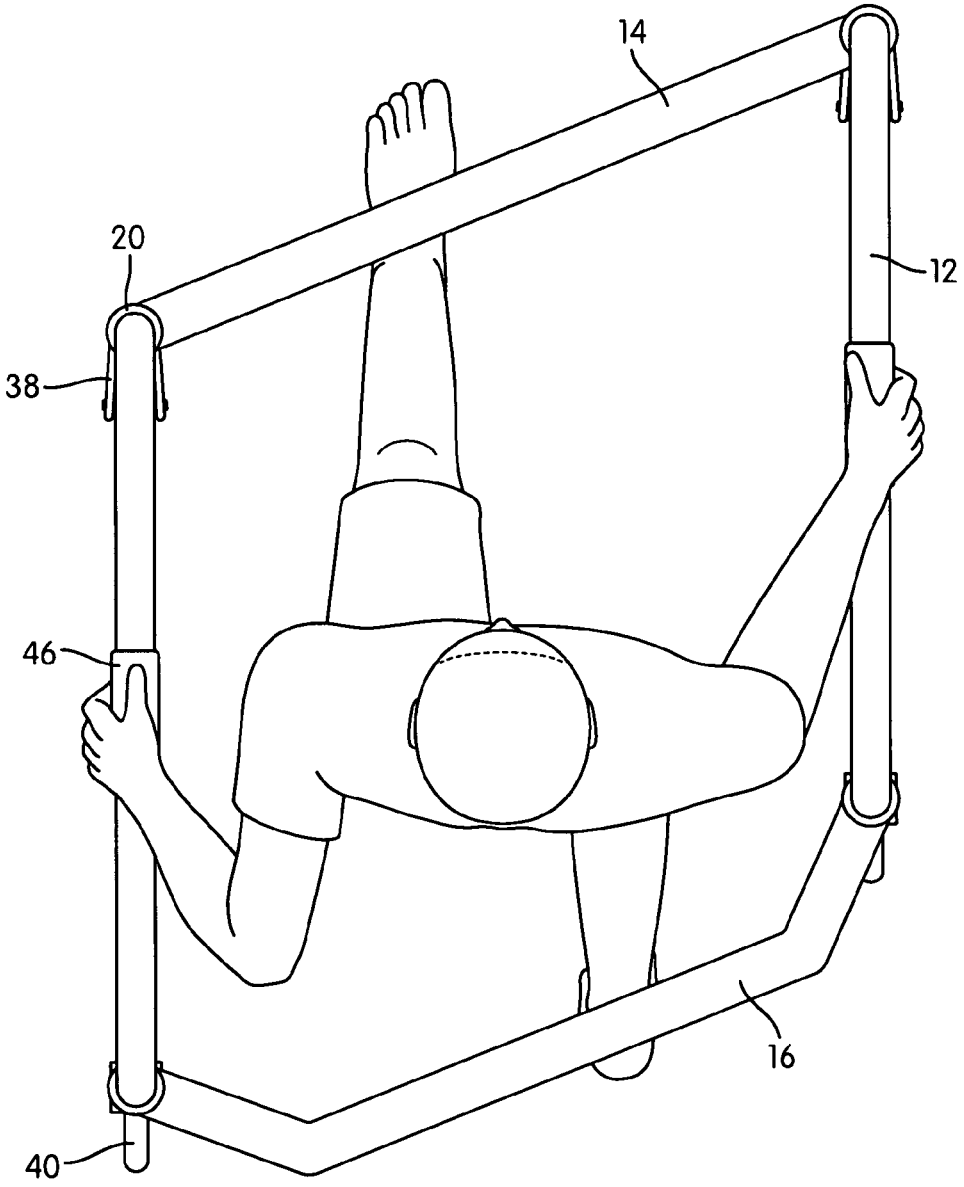
FIG. 9 illustrates a left stride position the natural gait walker.
Figure 10:
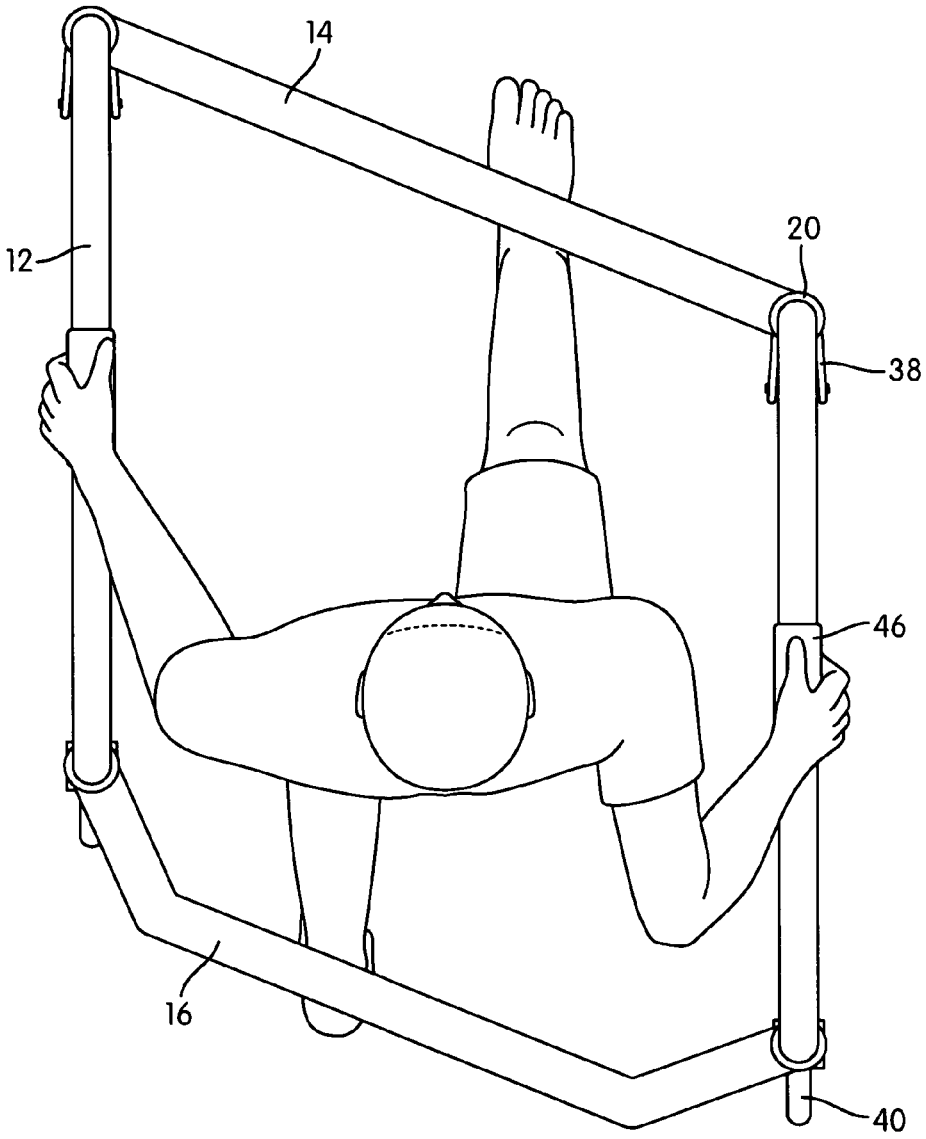
FIG. 10 illustrates a right stride position the natural gait walker.
Figure 11:
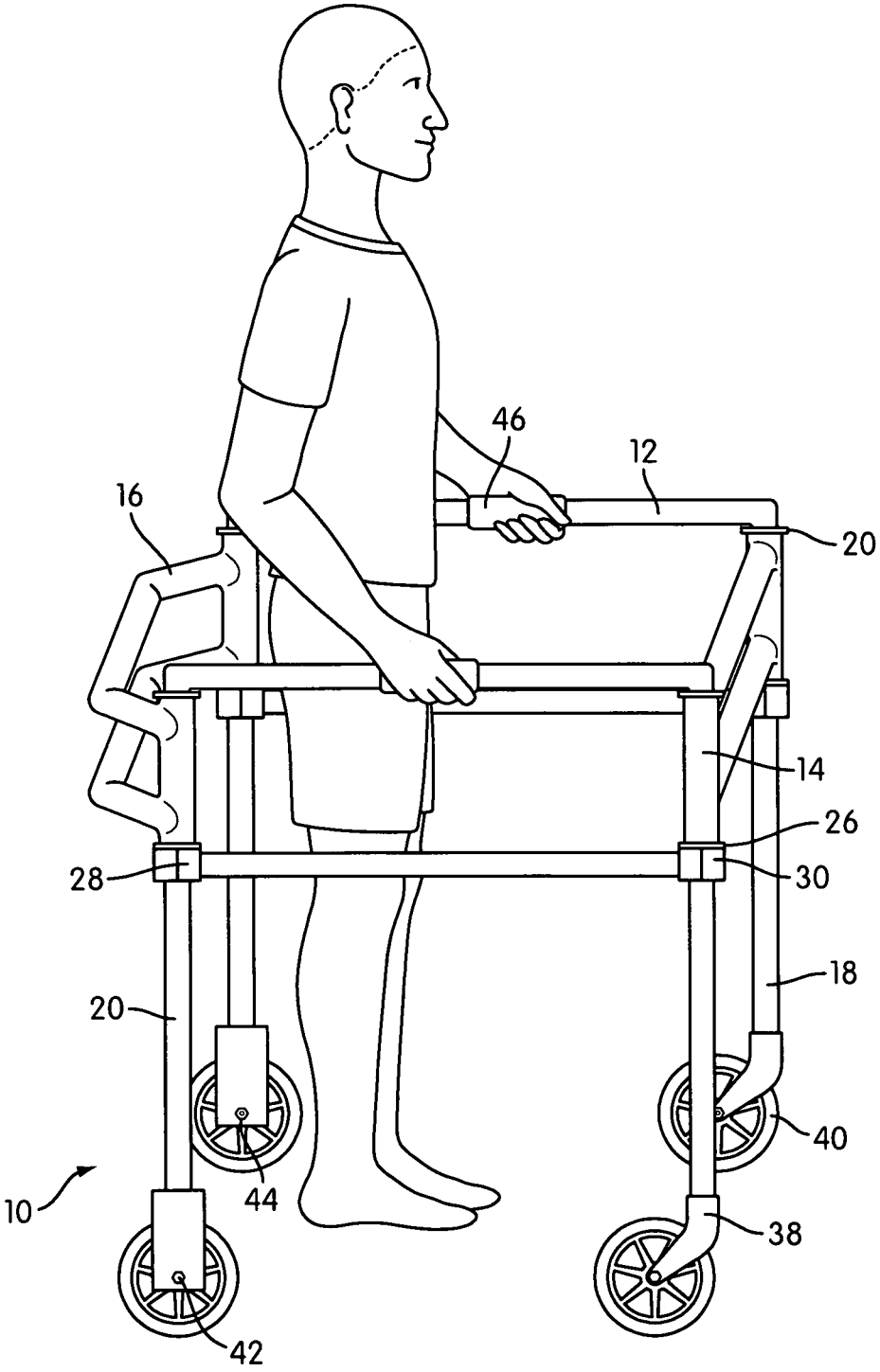
FIG. 11 illustrates a rectangular position of the natural gait walker.

The use of the upper bushings 20 and lower bushings 26 as described above is a key element in the "natural gait" training of the patient. If one views the natural gait walker from the top in a neutral position, one would see a rectangular shaped configuration. As the user begins walking he/she grips a grip 54 on each of the side assemblies 12, one with his/her left hand and the other with his/her right hand. In a natural gait walker, the view from top, the shape changes to a parallelogram with the right side in the front and the left side in the back (See FIG. 9) to a parallelogram with the left side in the front and the right side in the back (See FIG. 10). In this process the walker goes through a rectangular shape as shown in FIG. 11.

A mechanical bill of material for the natural gait walker is provided in Table 1 and is keyed to the item numbers in the figures. Items not included in this bill of material and in the drawings include: (1) the hand brakes used to regulate walker motion, (2) the strain gauges used to measure the weight borne by the walker structure, (3) the encoders used to measure walker speed/distance, (4) the electronic circuitry used to properly condition the strain gauge and encoder signals, and (5) the personal digital assistant (PDA) with data acquisition card used to acquire, log and display patient data in real-time.

In addition to a unique walker as described in FIGS. 4-11, certain four wheel rollators could be modified with a hinged system similar to that described above and as illustrated in FIGS. 4 and 5. A modified rollator would provide some of the features of the natural gait walker, but not all of them.

TABLE 1

| FIG. Item No. | Part | Quantity | Material | Configuration |
|---|---|---|---|---|
| 12 | Side Assembly | 2 | aluminum tubing | One per side |
| 28 | Side Beam | 2 | aluminum tubing | One per side |
| 16 | Rear Assembly | 1 | aluminum tubing | Single |
| 14 | Front Assembly | 1 | aluminum tubing | Single |
| 30 | Corner Clamp | 4 | aluminum | One per corner |
| 34 | Clamp Washer | 16 | steel | Four per corner |
| 36 | Clamp Bolt | 16 | steel | Four per corner |
| 20 | Upper Bushings | 4 | bronze (or nylon) | One per corner |
| 26 | Lower Bushings | 4 | bronze (or nylon) | Two per corner |
| 46 | Grip | 2 | foam | One per side |
| 10 | Caster | 2 | plastic/steel | One per front corner |
| 18 | Front Leg | 2 | aluminum tubing | One per front corner |
| 20 | Rear Leg | 2 | aluminum tubing | One per rear corner |
| 40 | Wheel | 4 | plastic | One per corner |
| 44 | Wheel nut | 4 | steel | One per corner |
| 42 | Wheel bolt | 4 | steel | One per corner |

Table 1 includes a Mechanical Bill of Material for the natural gait walker keyed to the mechanical diagrams of the natural gait walker that are sufficient to construct the device as illustrated in FIG. 4 through FIG. 8.

In addition to the basic natural gait walker as described above, certain accessory devices may be added to provide the user and his/her therapist information on the characteristics of the user's gait while using the device. These include a personal digital assistant with a data acquisition capability, strain gages, and wheel encoders. These devices provide real time feedback to the user and therapist regarding how much weight is being borne through each arm. In addition real time feedback is available to the user and the therapist on the user's speed of walking and distance. The assistive ambulatory device includes a wireless headset system that can be programmed to a specific walking/training cadence to provide a pace goal for user. Using the personal digital assistant equipped with a wireless connection, the therapist can monitor and change training parameters remotely. These accessory devices provide collected gait data can be stored, downloaded, and analyzed by a therapist to document patient progress and permit goal setting.

Device Testing:

A thorough three-step assessment of the natural gait walker is in process, but preliminary data examining the effect of the natural gait walker on various measures of gait suggest that the natural gait walker is more effective than other assistive devices at reproducing gait measures similar to walking without an assistive device. In phase one of the testing, gait kinematics are being assessed for healthy individuals ambulating with the natural gait walker and the results compared to ambulating with conventional assistive devices, e.g., a cane, Canadian crutches, a conventional walker, and with no assistive device (No-Ad). In a pilot study with a sample of five healthy individuals (summarized below in Table 2), it was found that gait speed and stride length for natural gait walker users was not significantly different than the No-Ad case in contrast to the other devices. In additional, gait speed was faster with the NGW] natural gait walker than compared to Canadian crutches and a conventional walker ($p<=0.005$, with p adjusted for multiple comparison in a post hoc test after a significant difference was found using a repeated measures ANOVA). Furthermore, stride length was not significantly different when using the NGW when compared to the No-Ad case, and was longer than when using a conventional walker ($p<=0.005$). Similarly stance time and swing time were not significantly different between the NGW and the No-Ad case, yet there were differences between the NGW and the other assistive devices.

TABLE 2

| Measure | Cane | Crutches | Walker | NGW | No-Ad |
|---|---|---|---|---|---|
| Cadence (steps/min.) | 77.33 | 70.93 | 63.37 | 92.00 | 96.93 |
| Normalized Velocity (m/s) | 0.86 | 0.89 | 0.35 | 1.02 | 1.13 |
| Stride length (cm) | 121.00 | 129.47 | 59.60 | 120.24 | 131.00 |
| Swing (% of gait cycle) | 31.80 | 31.10 | 14.50 | 33.50 | 34.40 |
| Stance (% of gait cycle) | 65.90 | 61.90 | 77.10 | 64.00 | 63.00 |
| Functional Amb. Profile | 83.00 | 74.33 | 49.00 | 92.67 | 96.00 |

Comparison of Assistive Ambulatory Devices for Various Measures of Gait.

Despite the small sample size, this preliminary evidence lends support to our claim that the natural gait walker allows individuals who may need to use an assistive device to walk more naturally, which in turn may improve and maintain their walking ability over time. For phase two, we will perform similar testing with a larger group of individuals with neurological conditions who use an assistive device to ambulate. In the third phase, we will incorporate the natural gait walker into a locomotor training regimen in a larger group of individuals who are undergoing rehabilitation as a result of a neurological injury.

The illustrative embodiments and modifications thereto described hereinabove are merely exemplary. It is understood that other modifications to the illustrative embodiments will readily occur to persons of ordinary skill in the art. All such modifications and variations are deemed to be within the scope and spirit of the present disclosure as will be defined by the accompanying claims.

REFERENCE LIST

The references listed below are incorporated herein by reference.

(1) Jorgensen H S, Nakayama H, Raaschou H O, Olsen T S. Recovery of walking function in stroke patients: the Copenhagen Stroke Study. *Archives of Physical Medicine & Rehabilitation* 1995; 76(1):27-32.

(2) Ghezzi A, Pozzilli C, Liguori M et al. Prospective study of multiple sclerosis with early onset. *Multiple sclerosis.* 2002 April; 8(2):115-8.

(3) Pittock S J, Mayr W T, McClelland R L et al. Disability profile of MS did not change over 10 years in a population-based prevalence cohort. *Neurology* 2004 February 24; 62(4):601-6.

(4) Myhr K M, Riise T, Vedeler C et al. Disability and prognosis in multiple sclerosis: demographic and clinical variables important for the ability to walk and awarding of disability pension. *Multiple sclerosis.* 2001 February; 7(1):59-65.

(5) Sullivan K J, Knowlton B J, Dobkin B H. Step Training with Body Weight Support: Effect of Treadmill Speed and Practice Paradigms on Poststroke Locomotor Recovery. *Archives of Physical Medicine and Rehabilitation* 2002; 83:683-91.

(6) Dobkin B H. An Overview of Treadmill Locomotor Training with Partial Body Weight Support: A Neurophysiologically Sound Approach Whose Time Has Come for Randomized Clinical Trials. *Neurorehabilitation and Neural Repair* 1999; 13:157-65.

(7) Fulk G D. Locomotor training with body weight support after stroke: the effect of different training parameters. *Journal of Neurologic Physical Therapy* 2004; 28(1):20-8.

(8) Nilsson L, Carlsson J, Danielsson A. et al. Walking training of patients with hemiparesis at an early stage after stroke: a comparison of walking training on a treadmill with body weight support and walking training on the ground. *Clinical Rehabilitation* 2001 October; 15(5):515-27.

(9) Behrman A L, Harkema S J. Locomotor Training After Human Spinal Cord Injury: A Series of Case Studies. *Physical Therapy* 2000; 80(7):688-700.

(10) Dobkin B H, Apple D, Barbeau H et al. Methods for a randomized trial of weight-supported treadmill training versus conventional training for walking during inpatient rehabilitation after incomplete traumatic spinal cord injury. *Neurorehabil Neural Repair* 2003 September; 17(3):153-67.

(11) Fulk G D. Locofnotor training and virtual reality-based balance training for an individual with multiple sclerosis: a case report. *Journal of Neurologic Physical Therapy* 2005; 29(1):34-42.

(12) Lovely R G, Gregor R J, Roy R R, Edgerton V R. Effects of training on the recovery of full-weight-bearing stepping in the adult spinal cat. *Exp Neurol* 1986; 92(2):421-35.

(13) Edgerton V R, Roy R R, Hodgson J A, Prober R J, de Guzman C P, de Leon R. A physiological basis for the development of rehabilitative strategies for spinally injured patients. *J Am Paraplegia Soc* 1991 October; 14(4):150-7.

(14) Barbeau H, Rossignol S. Recovery of locomotion after chronic spinalization in the adult cat. *Brain Res* 1987; 412:84-95.

(15) Barbeau H. Locomotor training in neurorehabilitation: emerging rehabilitation concepts. *Neurorehabil Neural Repair* 2003 March; 17(1):3-11.

We claim:

1. An assistive ambulatory device comprising:

a four sided walker further comprising a plurality of hinging devices mounted on each leg of said walker wherein said walker can be continuously changed from a rectangular shape to a parallelogram shape with a left side of the walker in a forward position or from a rectangular shape to a parallelogram shape with a right side in a forward position wherein said walker maintains a parallelogram shape when in use and further wherein said plurality of said hinged legs exert a variable friction of movement of said hinges so as to provide a therapeutic natural gait of a patient's movement further wherein using said four sided ambulatory device by having a patient positioned in a middle area of said device to allow for an upright trunk, minimizing abnormal lower extremities kinematics and weight bearing on arms;

further wherein said ambulatory device having hinged corners with adjustable friction permitting a change of shape of said ambulatory device from a rectangular shape to a parallelogram shape having a left side forward and/or a parallelogram shape having a right side forward allowing said patient's reciprocal arm swing when unlocked;

further wherein using four wheels permitting a continuous stepping motion that does not disrupt patient's normal gait kinematics;

further wherein having an adjustable height allows said ambulatory device to have an optimal height for placement of patient hands to minimize weight bearing on arms; and further wherein said adjustable friction of said hinges assists a patient in reacquiring a proper natural gait.

2. The device of claim 1 wherein said changes in shape of the walker are in synchronism with the positions of a user's legs and arms.

3. The device of claim 1 comprising:

a front assembly;

a rear assembly;

a pair of side assemblies;

a pair of side beams;

a plurality of said hinged corners having a range of adjustable friction; a pair of front legs;

a pair of rear legs; a pair of casters;

a plurality of wheels; and said adjustable height and wherein said plurality of hinged corners with an adjustable friction provide a natural gait of patient movement.

4. The device of claim 3 further comprising: a front portion of a first side assembly coupled through a first upper bushing;

a first portion of a said front assembly, a first lower bushing; and a front portion of a first side beam with a clamp assembly to a first front leg.

5. The device of claim 3 further comprising:

a front portion of a second side assembly coupled through a second upper bushing;

a second portion of a said front assembly;

a second lower bushing and a front portion of a second side beam with a clamp assembly to a second front leg.

6. The device of claim 3 further comprising:

a rear portion of a first side assembly coupled through a first upper bushing;

a first portion of a said front assembly;

a first lower bushing; and a front portion of a first side beam with a clamp assembly to a first front leg.

7. The device of claim 3 further comprising:

a front portion of a second side assembly coupled through a second upper bushing;

a second portion of a said front assembly, a second lower bushing; and a front portion of a second side beam with a clamp assembly to a second front leg.

8. The device of claim 3 wherein said front legs are coupled to a said pair of casters which are further coupled to a pair of said wheels.

9. The device of claim 3 wherein said rear legs are coupled directly to a pair of said wheels.

10. The device of claim 3 comprising:

a personal digital assistant with a data acquisition capability, strain gages, and wheel encoders wherein said personal digital assistant provides data on gait situations and/or gait kinematics.

11. The device of claim 10 wherein said device provides real time feedback to a user and therapist regarding how much weight is being borne through each arm.

12. The device of claim 10 further comprising real time feedback to user and therapist on user's speed of walking and distance.

13. The device of claim 10 wherein collected gait data can be stored, downloaded, and analyzed by a therapist to document patient progress and permit goal setting.

14. The device of claim 10 further comprising a wireless headset that can be programmed to a specific walking/training cadence to provide a pace goal for a user.

15. The assistive ambulatory device of claim 10 further comprising a personal digital assistant equipped with wireless connection wherein a therapist can monitor and change training parameters remotely.

16. A method for producing a natural gait by of a patient comprising:

using a four sided ambulatory device having said patient positioned in a middle area of said device to allow for an upright trunk, minimizing abnormal lower extremities kinematics and weight bearing on arms;

said ambulatory device having hinged corners with adjustable friction permitting a change of shape of said ambulatory device from a rectangular shape to a parallelogram shape having a left side forward and/or a parallelogram shape having a right side forward allowing user's reciprocal arm swing when unlocked;

using four wheels permitting a continuous stepping motion that does not disrupt normal gait kinematics; and having an adjustable height to allow said ambulatory device to have an optimal height for placement of patient hands to minimize weight bearing on arms wherein said adjustable friction of said hinges assists a patient in reacquiring a proper natural gait.

17. The device of claim 16 comprising:

a front assembly;

a rear assembly;

a pair of side assemblies; a pair of side beams;

a plurality of said hinged corners having a range of adjustable friction;

a pair of front legs;

a pair of rear legs;

a pair of casters;

a plurality of said wheels; and said adjustable height and wherein said plurality of hinged corners with an adjustable friction provide a natural gait of patient movement.

18. The device of claim 16 further comprising:

a front portion of a first side assembly coupled through a first upper bushing;

a first portion of said front assembly, a first lower bushing; and a front portion of a first side beam with a clamp assembly to a first front leg.

19. The device of claim 16 further comprising:

a front portion of a second side assembly coupled through a second upper bushing; a second portion of a front assembly;

a second lower bushing and a front portion of a second side beam with a clamp assembly to a second front leg.

20. The device of claim 16 further comprising:

a rear portion of a first side assembly coupled through a first upper bushing;

a first portion of said front assembly;

a first lower bushing; and a front portion of a first side beam with a clamp assembly to a first front leg.

21. The device of claim 16 further comprising:

a front portion of a second side assembly coupled through a second upper bushing; a second portion of said front assembly, a second lower bushing; and a front portion of a second side beam with a clamp assembly to a second front leg.

22. The device of claim 16 wherein said front legs are coupled to a pair of casters which are further coupled to a pair of said wheels.

23. The device of claim 16 wherein said rear legs are coupled directly to a pair of wheels.

24. The device of claim 16 comprising:

a personal digital assistant with a data acquisition capability, strain gages, and wheel encoders.

25. The device of claim 24 wherein said device provides real time feedback to a user and therapist regarding how much weight is being borne through each arm.

26. The device of claim 24 further comprising real time feedback to user and therapist on user's speed of walking and distance.

27. The device of claim 16 further comprising a wireless headset that can be programmed to a specific walking/training cadence to provide a pace goal for a user.

28. The assistive ambulatory device of claim 16 further comprising a personal digital assistant equipped with wireless connection wherein a therapist can monitor and change training parameters remotely.

29. The device of claim 16 wherein collected gait data can be stored, downloaded, and analyzed by a therapist to document patient progress and permit goal setting.

30. The assistive ambulatory device of claim 16 further comprising a personal digital assistant equipped with wireless connection wherein a therapist can monitor and change training parameters remotely.

* * * * *